US006308506B2

(12) United States Patent
Schnegg et al.

(10) Patent No.: US 6,308,506 B2
(45) **Date of Patent: *Oct. 30, 2001**

(54) PRODUCTION OF COLOR BLENDED YARN FOR DENIM CONSTRUCTION

(75) Inventors: Julius R. Schnegg, Burlington; Charles F. Bino, High Point; James E. MacFarland, Mooresville; Ben M. Croker, Greensboro; Edward W. Teague, Raleigh, all of NC (US)

(73) Assignee: Burlington Industries, Inc., Greensboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/832,014

(22) Filed: Apr. 11, 2001

Related U.S. Application Data

(63) Continuation of application No. 09/215,564, filed on Dec. 18, 1998, now abandoned.

(51) Int. Cl.[7] ..... D01H 1/02

(52) U.S. Cl. ..... 57/1 R; 57/2; 28/100; 28/299; 19/65; 19/107; 19/145.5

(58) Field of Search ..... 57/1 R, 2; 28/100, 28/299; 19/65, 107, 145.5

(56) References Cited

U.S. PATENT DOCUMENTS

| | | | | |
|---|---|---|---|---|
| 3,457,022 | | 7/1969 | Fields . | |
| 4,283,198 | | 8/1981 | Fletcher . | |
| 4,845,789 | | 7/1989 | Morton et al. . | |
| 5,061,290 | | 10/1991 | Koshida et al. . | |
| 5,350,425 | | 9/1994 | Carver . | |
| 5,361,438 | | 11/1994 | Parati . | |
| 5,369,861 | * | 12/1994 | Ball et al. | 28/299 |
| 5,378,246 | | 1/1995 | Gurley . | |
| 5,471,720 | * | 12/1995 | Ball et al. | 28/299 |
| 5,514,187 | * | 5/1996 | McFarland et al. | 8/401 |
| 5,518,508 | * | 5/1996 | Kuehnel et al. | 8/502 |
| 5,519,925 | * | 5/1996 | Ball et al. | 28/299 |
| 5,586,992 | | 12/1996 | Schnitzer et al. . | |
| 6,023,925 | * | 2/2000 | Schnegg et al. | 57/1 |

* cited by examiner

*Primary Examiner*—John J. Calvert
*Assistant Examiner*—Shaun R Hurley
(74) *Attorney, Agent, or Firm*—Nixon & Vanderhye

(57) ABSTRACT

Denim fabric and articles of clothing having a "washed" or heather look/effect are produced in a manner that retains color intensity and substantially avoids the waste of chemicals and/or water inherent in conventional washing processes. A first coarse feeder yarn of cotton and/or other natural fiber by ring or open end spinning, and then is continuously dyed (such as by indigo rope dyeing, slasher dyeing, or sheet dyeing). The dyed yarn is dried and then cut up into lengths of about four inches long or less (and opened if necessary) into individual fibers. The fibers are blended with other fibers (e.g. about 10–90% greige fibers) to produce a blended composite. The blended composite is then carded, spun into yarn, and woven into denim fabric having a washed look, or a heather effect, which then can be made into any suitable article. A second coarse yarn made similar to the first coarse yarn may be added to the blending station.

23 Claims, 2 Drawing Sheets

PRODUCTION OF COLOR BLENDED YARN FOR DENIM CONSTRUCTION

This is a continuation of application Ser. No. 09/215,564, filed Dec. 18, 1998, now abandoned, the entire content of which is hereby incorporated by reference in this application.

BACKGROUND AND SUMMARY OF THE INVENTION

In the conventional production of yarn for denim fabrics, denim fabrics themselves, and articles of clothing made from denim fabrics, it is desirable to obtain a "washed" look, that is that the fabric, for example, looks like it has already been washed many times even though it is new. Conventional techniques for doing this result in loss of the intensity or brilliance of the color, and also result in a significant waste of chemicals and/or water to achieve the desired look.

According to the present invention, a method and products are provided which allow production of denim yam, fabric, and articles of clothing, that have a desired "washed" look, yet retain color intensity and substantially avoid the waste of chemicals and/or water inherent in conventional processes. Alternatively, the invention can provide an inexpensive heather look (effect) yam, fabric, and/or product.

The invention utilizes the general techniques disclosed in U.S. Pat. No. 6,023,925 (the disclosure of which is hereby incorporated by reference herein) to provide the desired results achieved.

According to one aspect of the present invention there is provided a method of making a colored yarn, comprising the steps of substantially sequentially: (a) Producing a first coarse feeder yarn of cotton and/or other natural fiber. (b) Indigo rope or sheet dyeing the first coarse feeder yarn. (c) Drying the dyed first coarse feeder yarn. (d) Cutting the first coarse feeder yarn into lengths of about four inches long or less, and, if necessary, opening the feeder yarn into individual fibers. (e) Blending the individual fibers from step (d) with other fibers to produce a blended composite of fibers. (f) Carding the blended composite of fibers. And, (g) spinning the composite of fibers into a final colored yarn having a heather effect or washed look.

Step (a) may be practiced by spinning a 0.5/1 to 6/1 (e.g. a 1/1 or a 2.5/1) yarn, e.g. by ring, open end, or other method, spinning the yarn to have between about 2–6 turns per inch.

Step (e) is typically also practiced using at least some greige staple fibers. For some products, step (e) is practiced by blending between about 10–90% (preferably about 20–80%) first individual fibers with 10–90% (preferably about 20–80%, and at least 10%) greige staple fibers, or greige staple fibers combined with still other fibers.

The invention may also comprise the further steps of: (a1) producing a second coarse feeder yarn (of any type of fibers, natural or synthetic, e.g. cotton, hemp, rayon, polyester, acrylic, nylon, and/or blends thereof); (b1) dyeing the second coarse feeder yarn a second color; (c1) drying the dyed second coarse feeder yarn; and (d1) cutting the dried second coarse feeder yarn into lengths of about four inches long or less and, if necessary, opening it up into second individual fibers; and step (e) may be practiced by blending the first and second, differently colored, individual fibers together (with or without greige fibers).

The invention may further comprise (h) making the yarn from (g) into denim fabric, and (i) making the denim fabric into an article of clothing (or other utilitarian article), and (a) may be practiced using substantially all cotton fiber having lengths between about 0.5–1.5 inches. Also, (a)–(i) may be practiced to produce a denim article of clothing having a washed look without loss of color or dye stuff, and without chemicals, enzymes, pumice and other stones, or water usage by known methods which use chemicals, "stone washing" or other washing methods to provide a washed look, or (a) through (i) may be practiced to produce a denim article of clothing having a heather effect; or stopping at the fabric making step, washed look or heather effect fabrics may be produced.

The invention also relates to yarns, fabrics, and articles of clothing made according to the methods set forth above.

According to another aspect of the invention there is provided a method of making a colored yarn, comprising substantially sequentially: (a) Producing a first coarse feeder yarn of primarily cotton fibers having fiber lengths of between about 0.5–1.5 inches, and about 2–6 turns (e.g. 3–6 turns) per inch. (b) Continuous dyeing the coarse feeder yarn. (c) Drying the dyed yarn. (d) Opening the coarse feeder yarn up into individual fibers. (e) Blending the individual fibers from (d) with other fibers to produce a blended composite. And, (f) spinning the composite into a final colored yarn. The details of the method according to this aspect may be as set forth above, including the further step (g), between steps (e) and (e, of carding the fiber composite. Also, (b) may be practiced on any indigo dye range, or slasher, or sheet dyeing range.

According to still another aspect of the invention, a method of making a denim fabric is provided, comprising the steps of substantially sequentially: (a) producing a 0.5/1 to 6/1 first coarse feeder yarn of cotton and/or other natural fiber; (b) indigo ring dyeing the first coarse feeder yarn; (c) drying the dyed first coarse feeder yarn; (d) cutting up the dried first coarse feeder yarn into lengths of about four inches or less to produce first individual fibers, and, if necessary, opening the feeder yarn into individual fibers and then, if necessary, blending these fibers; (e) carding the (blended, if desired) ring dyed coarse feeder yarn to achieve a desired final color; (f) spinning the carded, and blended if desired, ring dyed yarn into a final colored yarn having a washed look; and (g) making the yarn from (f into denim fabric having a washed look. In the practice of this aspect (e) is preferably practiced by acting only on the ring dyed coarse feeder yarn itself, that is without any blending with other yams. This is possible because in indigo ring dyeing only the circumferential portion of the yarn is dyed—the core remains undyed, and blending if desired, and carding can then result in portions of the core being exposed, resulting in a "washed" look. However before (e) the indigo ring dyed yarn can also be blended with other yarns if desired.

It is the primary object of the present invention to provide an effective and simple method of making a colored yarn, particularly for denim constructions having a heather effect or washed look. This and other objects of the invention will become clear from an inspection of the detailed description of the invention and from the appended claims.

DETAILED DESCRIPTION OF THE DRAWINGS

Figure 1:
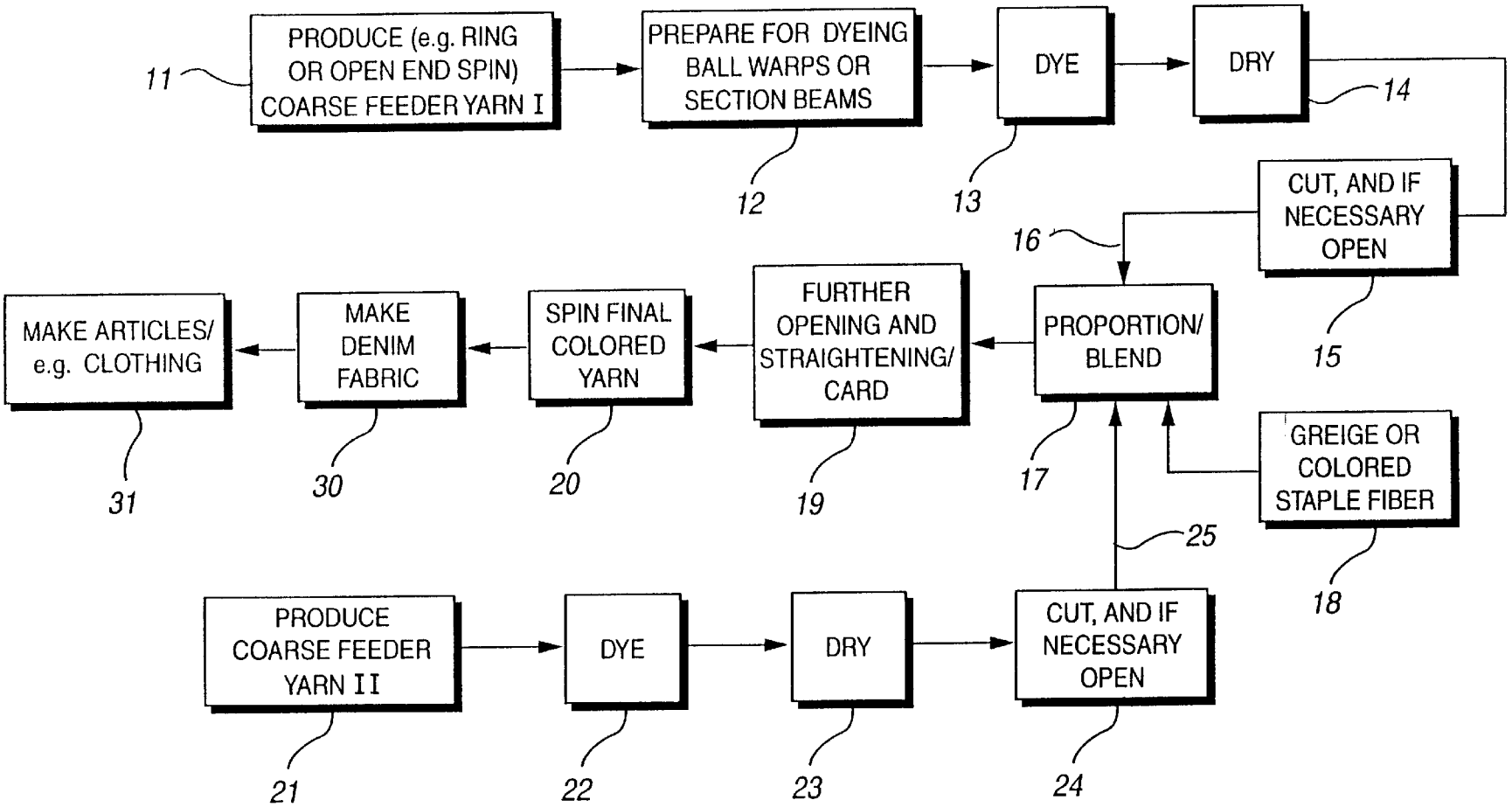
FIG. 1 is a schematic, box diagram indicating exemplary method steps that may be practiced for producing colored yarns, and denim fabrics and articles, according to the present invention.

FIG. 1 schematically illustrates exemplary method steps that may be practiced in the production of colored yarns according to the present invention, particularly for denim fabrics and articles, that can be produced more cheaply than by using either producer dyed or stock dyed yarns, and to produce denim having a "washed" look or a heather effect, more inexpensively and desirably than by conventional techniques.

According to the present invention a first coarse feeder yarn is produced as indicated generally by reference numeral 11. Step 11 is typically practiced by spinning (such as ring or open end spinning) a 0.5/1 to 6/1 (e.g. about 1/1 or 2.5/1) yarn. The coarse yarn produced in 11 is preferably made at least primarily of staple cotton or other natural fibers. Other fibers can be used in addition to cotton or natural fibers. Where cotton fibers are utilized, the cotton staple fibers typically have a staple length of between about 0.5–1.5 inches. What fibers are used depends upon the particular nature of the denim fabric to be produced, the dyeing techniques used, and the like.

The coarse yarn from 11 is prepared for dyeing at 12. Depending upon the particular dyeing technique that is utilized at 13 the yarn at 12 may be acted upon in different manners. For example the coarse yarn from 11 is wound onto section beams at 12 for sheet or slasher dyeing at 13. Or the yarn from 11 may be formed into ropes at 12, e.g. ropes of multiple threads (20–300) wound around shells. Where the dyeing step 13 is practiced utilizing an indigo rope range, one may dye from one to 48 ropes at one time, generally from 12–40 ropes, at stage 13. The dyeing at 13 may be practiced using a wide variety of dyeing systems, such as vat, sulfur, reactive, napthol, padazoic, directs, and pigment, and are not limited to any one particular system.

After dyeing at 13, the dyed yarn is dried as indicated at 14 in any conventional manner (e.g. an infra-red or hot air drying oven).

After drying at 14, the yarn, for example the ropes from dyeing, are cut, and perhaps is opened up, at 15. In another example the ropes may be opened up into a sheet and wound in section beams, and then cut at 15.

Step 15 in FIG. 1 may be practiced by utilizing any conventional yarn cutting equipment, and typically is practiced to cut the dyed, dried first coarse feeder yarn into lengths of about four inches long or less, to produce first individual fibers. Because the first coarse feeder yarn produced in step 11 has minimum turns, and because it is preferably produced in a technique where the fibers are not significantly intertangled, the fibers readily open up merely upon cutting and subsequent conveyance on a conveyor belt, pneumatically, or in other conventional manners. However in situations where the yarns do not readily open up, conventional equipment can be used for facilitating opening up of the "cut threads" into individual fibers, such as by fluid blasts, vibration, mechanical action, movement through an air jet or other fluid flow chamber, or the like (e.g. one conventional method being simply carding the cut threads to open them).

The individual fibers from step 15 are passed—as indicated at 16 in FIG. 1—to a blending station 17 where they are blended with themselves if desired, and/or with other fibers, such as greige or colored staple fibers from source 18. The blending station 17 may include any conventional blending equipment for moving the fibers together so that they are relatively uniformly dispersed. Any proportioning of the first fiber 16 and the greige or colored staple fibers from 18 may be provided and controlled by the speed of practice of the steps 11 through 15, and/or the speed of conveyance of the fibers from 18, or by putting in suitable flow control devices. For example about 10–90% first individual fibers from line 16 may be blended with about 90–10% greige or colored staple fibers from source 18, or the like, e.g. at least 10% greige or colored staple fibers. A preferred range is more than 60% fibers from 15 to less than 40% greige fibers from 18 (e.g. about 75% to 25%, or about 80% to about 20%).

After the fibers are blended in the desired proportions, as indicated at 17 in FIG. 1, a composite of fibers is produced. It is desirable to also further open and straighten the blended composite of fibers from 17, as by conventional carding, as indicated schematically at 19 in FIG. 1. The composite, blended if desired, carded, fibers are then made into a final colored yam, such as by spinning (e.g. such as ring spinning, open end spinning, or other conventional techniques) as illustrated schematically at 20 in FIG. 1.

In addition to the greige or colored staple fibers from source 18, or in place of them, other fibers may be blended at station 17 to produce a desired final yarn. For example as also schematically illustrated in FIG. 1 a second coarse feeder yarn may be produced as indicated at 21, dyed as indicated at 22, dried as indicated at 23, and cut (if necessary) and opened up as indicated at 24, with the second individual fibers then fed in line 25 to the blending station 17. Again the various yarns may be proportioned (in the proportion ranges given above) by utilizing speed controls for the processes, flow control devices, or the like. The fibers used may be of almost any type, natural or synthetic, e.g. cotton, wool, hemp, rayon, polyester, acrylic, nylon, polypropylene, and/or blends thereof.

Alternatively according to another aspect of the invention, an indigo ring dyed yarn (that is, 13 is practiced by ring dyeing on an indigo rope dye range) can be carded and spun without adding other fibers, to achieve the "washed" look. That is instead of a blending stage 17, stage 17 may be a conventional carding stage (in which case subsequent carding stage 19 is unnecessary) in which only indigo ring dyed yarn is acted upon. This is possible because in indigo ring dyeing only the circumferential portion of the yarn is dyed—the core remains undyed, and blending and/or carding can then result in portions of the core being exposed, resulting in a "washed" look. However even if ring dyed yarn is used, stage 17 can also be practiced by blending other yarns with the indigo ring dyed yarn (and then preferably subsequently carding at 19).

The final yarn from 20 is preferably made into denim fabric, as indicated schematically at 30 in FIG. 1. The manner of making the denim fabric at 30 is any conventional suitable manner, such as weaving on a conventional loom for making denim. Ultimately the denim fabric, as is indicated schematically at 31 in FIG. 1, is made into a useful article, such as an article of clothing, knapsack, handbag, seat cushion cover, curtain, or any other conventional utilitarian article that can be made from denim.

Figure 2:
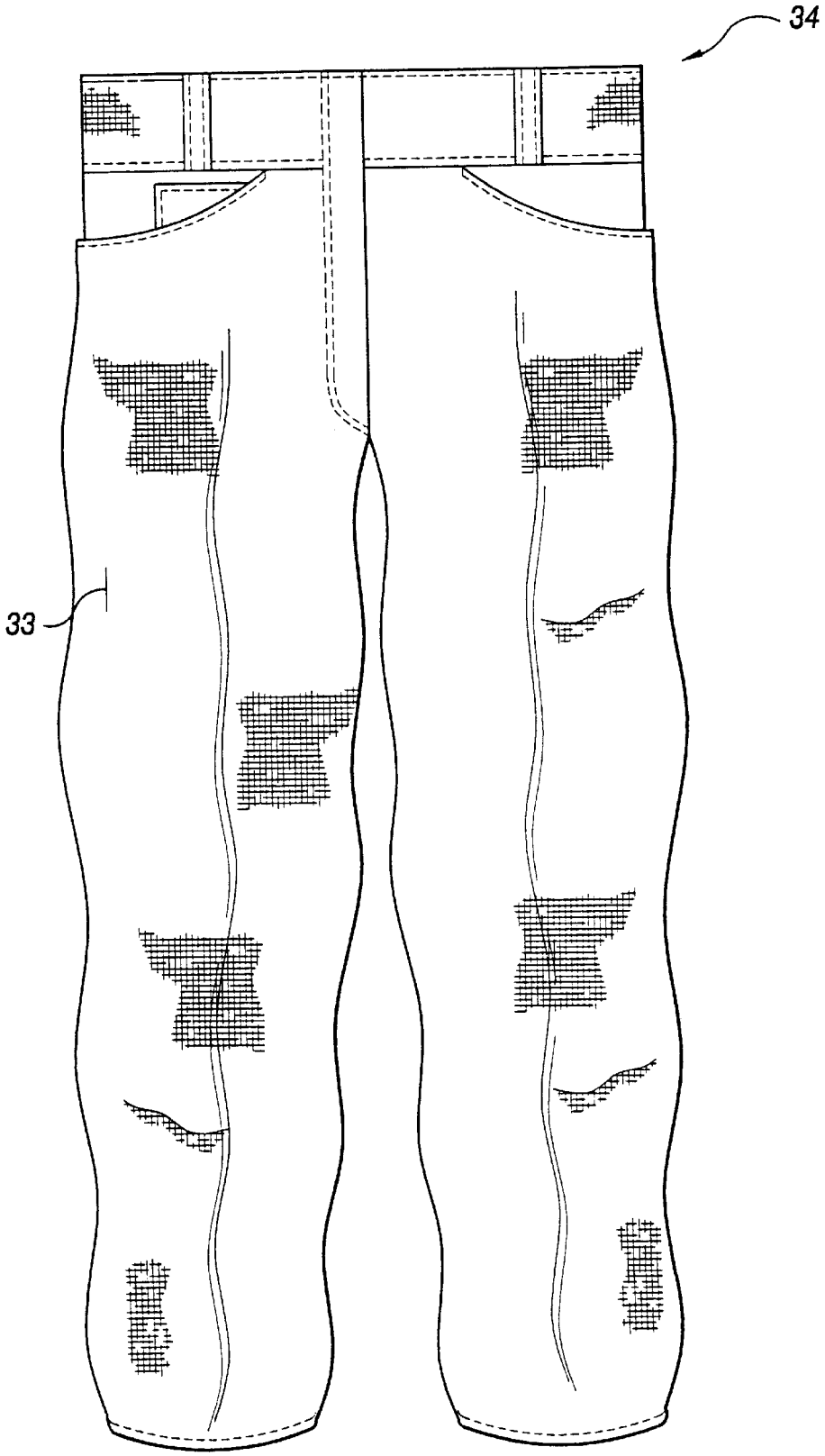
FIG. 2 is a schematic representation of a piece of denim fabric according to the invention made into an article of clothing according to the present invention.

The exemplary denim cloth 33 according to the invention which has been made into an article of clothing, for example, jeans or pants 34, is illustrated schematically in FIG. 2. The denim fabric 33, and the article of clothing 34, can be made by the practice of the method steps in FIG. 1 so as to have an inexpensive heather look (effect), or to have a "washed" look. Despite the fact that a "washed" look is obtained for the fabric 33 and article 34, according to the invention the color introduced by dyeing at 13 is maintained in intensity, and one is able to substantially avoid the waste of dyestuffs, chemicals, "stone washing" materials and/or water inherent in conventional processes for producing a "Washed" look or denim.

A particular non-limiting example for the manufacture of the denim fabric 33 according to the present invention is as follows:

EXAMPLE 1

Cotton staple fibers having a staple length between about 0.5–1.5 inches are open end spun (at 11), to have about four turns per inch, providing approximately 1/1 open end yam, to produce a first coarse feeder yarn, and then prepared for dyeing (at 12) by forming ropes of multiple threads (approximately 200 threads per rope). The ropes are wound around shells and fed to an indigo rope dye range (at 13) which dyes approximately 20 ropes at a time. After dyeing the ropes are dried (at 14), cut and then opened using air jets (at 15) and proportion blended (at 17) with greige staple fibers (18). The proportion of fibers blended (at 17) is about 80% cotton fibers from 18 to about 20% greige staple fibers from 18. The fibers from the blend at 17 are then further opened and straightened using a conventional carding machine (at 19) and then open end spun (at 20) to produce the final yarn. The final yarn is then woven (at 30) into a denim fabric at 33, that has a "washed" look that is difficult to distinguish from new denim having a "washed" look produced by conventional bleaching, washing, laundering and stone and/or enzyme washing techniques.

It is to be understood that for all of the broad ranges set forth above, any and all narrower ranges within that broad range are provided according to the invention. For example feeder yarns within the broad range of 0.5/1 to 6/1 may also be provided within the narrower ranges of 1/1 to 5/1, 3/1 to 5.511, and all other narrower ranges within the broad range.

While the invention has been herein shown and described in what is presently conceived to be the most practical and preferred embodiment thereof, it will be apparent to those of ordinary skill in the art that many modifications may be thereof within the scope of the invention, which scope is to be accorded the broadest interpretation of the appended claims so as to encompass all equivalent methods and products.

What is claimed is:

1. A method of making a product, comprising the steps of substantially sequentially:

(a) producing a first coarse feeder yarn of at least one of cotton and other natural fiber;

(b) indigo rope dyeing the first coarse feeder yarn;

(c) drying the dyed first coarse feeder yarn;

(d) cutting up the dried first coarse feeder yarn into lengths of about four inches long or less to produce first individual fibers, and, if necessary, opening the feeder yarn;

(e) blending the individual fibers from step (d) with other fibers to produce a blended composite of fibers;

(f) carding the blended composite of fibers; and (g) spinning the composite of fibers into a final colored yarn having a washed look.

2. A method as recited in claim 1 wherein step (a) is practiced by spinning a 0.5/1 to 6/1 yarn as the first coarse feeder yarn.

3. A method as recited in claim 2 wherein step (a) is practiced by ring or open end spinning the yarn to have between about 2–6 turns per inch.

4. A method as recited in claim 1 further comprising: (h) making the yarn from (g) into denim fabric, and (i) making the denim fabric into an article of clothing.

5. A method as recited in claim 4 wherein (a) is practiced using substantially all cotton fibers having a length of between about 0.5–1.5 inches.

6. A method as recited in claim 4 wherein steps (a)–(i) are practiced to produce a denim article of clothing having a washed look without loss of color, and without chemical and water usage of known methods which use chemicals and washing to provide a washed look.

7. A method as recited in claim 4 wherein steps (a)–(i) are practiced to produce a denim article of clothing having a washed look.

8. A method as recited in claim 1 wherein step (e) is practiced using at least some greige or colored staple fibers.

9. A method as recited in claim 8 wherein step (e) is practiced by blending between about 10–90% first individual fibers with at least 10% greige or colored staple fibers.

10. A method as recited in claim 1 comprising the further steps of (a1) producing a second coarse feeder yarn; (b1) dyeing the second coarse feeder yarn a second color; (c1) drying the dyed second coarse feeder yarn; and (d1) cutting the dried second coarse feeder yarn into lengths of about four inches long or less and, if necessary, opening it into second individual fibers; and wherein step (e) is practiced by blending the first and second, differently colored, individual fibers together.

11. A method as recited in claim 1 further comprising (h) making the yarn into denim fabric having a washed look.

12. A denim fabric made according to the method of claim 11.

13. A method as recited in claim 3 further comprising (h) making the yarn into denim fabric having a washed look.

14. A denim fabric made according to the method of claim 12.

15. A method as recited in claim 1 wherein step (a) is practiced using at least primarily cotton fibers having a length of between about 0.5–1.5 inches, and having about 2–6 turns per inch.

16. A yarn made according to the method of claim 1.

17. A method of making a product, comprising substantially sequentially:

(a) producing a first coarse feeder yarn of primarily cotton fibers having a length of between about 0.5–1.5 inches, and about 2–6 turns per inch;

(b) continuous indigo dyeing the coarse feeder yarns;

(c) drying the dyed yarn;

(d) cutting the coarse feeder yarn up into individual fibers;

(e) blending the individual fibers from (d) with other fibers to produce a blended composite; and (f) spinning the composite into a final colored yarn.

18. A method as recited in claim 17 further comprising (g), between (e) and (f), carding the blended composite; and further comprising (h) making the yarn into denim fabric having a washed look.

19. A method as recited in claim 17 further comprising (g), between (e) and (f), carding the blended composite; and further comprising (h) making the yarn into denim fabric having a heather effect.

20. A method as recited in claim 17 wherein (b) is practiced on an indigo dye range, slasher, or sheet dyeing range.

21. A method of making a denim fabric, comprising the steps of substantially sequentially:

(a) producing a 0.5/1 to 6/1 first coarse feeder yarn of at least one of cotton and other natural fiber;

(b) indigo ring dyeing the first coarse feeder yarn;

(c) drying the dyed first coarse feeder yarn;

(d) cutting up the dried first coarse feeder yarn into lengths of about four inches long or less to provide first individual fibers, and, if necessary, opening the feeder yarn;

(e) carding the indigo ring dyed coarse feeder yarn to achieve a desired final color;

(f) spinning the carded ring dyed yarn into a final colored yarn having a washed look; and (g) making the yarn from (f) into denim fabric having a washed look.

22. A method as recited in claim 21 wherein (e) is practiced using only the indigo ring dyed coarse feeder yarn.

23. A denim fabric made according to the method of claim 22.

* * * * *